US010888871B2

(12) United States Patent
Kong et al.

(10) Patent No.: US 10,888,871 B2
(45) Date of Patent: Jan. 12, 2021

(54) FOOD WASTE DISPOSER

(71) Applicant: Skybest Electric Appliance (Suzhou) Co., Ltd., Suzhou (CN)

(72) Inventors: Zhao Kong, Suzhou (CN); Fei Chen, Suzhou (CN); Ning Guo, Suzhou (CN); Guangyue Zhu, Suzhou (CN); Jianyong Lu, Suzhou (CN)

(73) Assignee: Skybest Electric Appliance (Suzhou) Co., Ltd., Suzhou (CN)

( * ) Notice: Subject to any disclaimer, the term of this patent is extended or adjusted under 35 U.S.C. 154(b) by 412 days.

(21) Appl. No.: 15/940,819

(22) Filed: Mar. 29, 2018

(65) Prior Publication Data

US 2019/0193087 A1 Jun. 27, 2019

(30) Foreign Application Priority Data

Dec. 22, 2017 (CN) ..... 2017 1 1400146

(51) Int. Cl.

| | |
|---|---|
| ***B02C 18/24*** | (2006.01) |
| ***E03C 1/266*** | (2006.01) |
| ***B02C 18/00*** | (2006.01) |
| ***B02C 18/16*** | (2006.01) |

(52) U.S. Cl.

CPC ..... *B02C 18/24* (2013.01); *B02C 18/0092* (2013.01); *E03C 1/2665* (2013.01); *B02C 2018/164* (2013.01)

(58) Field of Classification Search

CPC .... B09B 3/00; B09B 5/00; B09B 7/00; B09B 9/00; B09B 1/00; H02P 1/00; H02P 1/04; H02P 1/42; H02P 1/46; H02P 3/00; H02P 7/00; H02P 8/00; H02P 23/00; H02P 25/00; H02P 27/00; H02P 27/06; H02P 4/00; H02P 27/026; H02P 27/08; H02P 27/085; H02K 23/36; G05B 11/28; B02C 18/24; B02C 2018/164

USPC ..... 318/400.01, 700, 701, 721, 799, 800, 318/801, 599, 811

See application file for complete search history.

(56) References Cited

U.S. PATENT DOCUMENTS

| | | | | |
|---|---|---|---|---|
| 3,300,150 A * | 1/1967 | Sones | H02P 29/40 | 241/36 |
| 3,970,907 A * | 7/1976 | Meyers | B02C 18/24 | 318/755 |
| 4,026,480 A * | 5/1977 | Meyers | B02C 13/30 | 241/30 |
| 5,577,673 A * | 11/1996 | McMurphy | E03C 1/2665 | 241/33 |
| 6,548,983 B2 * | 4/2003 | Avella | H02P 7/29 | 318/599 |
| 8,487,577 B2 * | 7/2013 | Peterson | A47L 15/0018 | 318/478 |

* cited by examiner

*Primary Examiner* — Antony M Paul
(74) *Attorney, Agent, or Firm* — Flener IP & Business Law; Zareefa B. Flener

(57) ABSTRACT

A food waste disposer includes a food conveying section, a grind and discharge section and a motor section used for driving the grind and discharge section to execute a grinding process. The motor section includes a universal motor, the universal motor includes a control device for controlling the output of the universal motor, and the control device includes a rectifier bridge circuit module for converting an AC power signal into a DC power signal.

17 Claims, 10 Drawing Sheets

FOOD WASTE DISPOSER

CROSS-REFERENCE TO RELATED APPLICATIONS

This application claims priority from Chinese Patent Application Serial No. 201711400146.5, filed on Dec. 22, 2017, the entire contents of which are incorporated herein by reference for all purposes.

TECHNICAL FIELD

Embodiments of the present invention relate to a food waste disposer.

BACKGROUND

A food waste disposer is a machine for grinding meal residue, which uses a high-speed rotating motor to drive a grinding disc in a grinding chamber. The food waste collides with each other due to the centrifugal force, being grinded into fine particles in a very short period of time and discharged with water flow to the sewer. From the user's point of view, the food waste disposing process is required to have low noise and high grinding efficiency. Since the universal motor has the characteristics of high idle rotation speed, producing noise and soft motor characteristics, the universal motor can achieve the same drive effect of the brush permanent magnet motor only by increasing the load to decrease the rotation speed when the universal motor is in the idle state, thus the universal motor is not used in the disposers of the present market.

Most food waste disposers in the present market use inductive motors or permanent magnet motors. However, due to the weak overload capacity of the inductive motors, locked rotation often occurs when the waste is grinded, which may easily lead to damage to the machine and poor user experience. Besides, the permanent magnet motors need to use lots of magnets, and the price of the magnet is sustained grown due to the scarcity of rare earth, thus using permanent magnet motors does not meet the needs of sustainable development. Therefore, it is necessary to develop a kind of food waste disposer using a motor with lock protection function and low noise and being propitious to sustainable development.

SUMMARY

Embodiments of the present invention are directed to providing a food waste disposer with lock protection function, low noise and high safety.

According to an aspect of the present invention, a food waste disposer is provided, including a food conveying section, a grind and discharge section and a motor section used for driving the grind and discharge section to execute a grinding process; wherein the motor section comprises a universal motor, the universal motor comprises a control device for controlling a rotation speed of the universal motor, and the control device comprises a rectifier bridge circuit module for converting an AC power signal into a DC power signal.

In an embodiment, the control device further comprises a controller, a drive circuit, and a rotation speed detector; the rotation speed detector is connected with the controller and configured to transmit a detected rotation speed signal to the controller; the controller is connected with the drive circuit and configured to transmit different control signals to the drive circuit after perform judgment based on the detected rotation speed signal; and the drive circuit is configured to output corresponding power source voltage of different values to the universal motor, varied with the different control signals.

In an embodiment, the rotation speed detector comprises a sensing circuit, and the sensing circuit comprises a magnet ring coaxially configured on a motor shaft of the universal motor and an inductive element that coordinates with the magnet ring for detecting the rotation speed of the universal motor.

In an embodiment, the sensing circuit further comprises a filter capacitor configured parallel to the inductive element.

In an embodiment, the rotation speed detector further comprises an amplifier circuit connected with an output of the sensing circuit.

In an embodiment, the amplifier circuit comprises a first transistor, and a collecting electrode of the first transistor is connected through a fifth resistance to a fourth input of the controller.

In an embodiment, the rectifier bridge circuit module is connected between the drive circuit and the universal motor.

In an embodiment, the drive circuit comprises a third transistor and a thyristor, a second output of the controller is connected to a base electrode of the third transistor, a collecting electrode of the third transistor is connected through a ninth resistance to a gate of the thyristor.

In an embodiment, the control device further comprises a voltage-stabilizing and filtering module connected with a power supply.

In an embodiment, the control device further comprises a zero crossing detector, the zero-cross detector comprises a twelfth resistance in series with a thirteenth resistance, and an end of the thirteenth resistance is connected to a third input of the controller.

In an embodiment, the drive circuit comprises a thyristor; wherein the zero crossing detector module is adapted to detect zero crossings and control the ON-time of the thyristor based on the detected zero crossings.

In an embodiment, the universal motor further comprises a stall protection device for disconnecting working power when the rotation speed of the universal motor exceeds a preset rotation speed.

In an embodiment, the stall protection device comprises a clutch device configured on a motor shaft of the universal motor, an actuation device, and a switch device connected in series with a universal motor circuit; wherein the clutch device is used for making the actuation device act and disconnect the switch device when the rotation speed of the universal motor exceeds the preset rotation speed.

In an embodiment, the actuation device comprises: a shell, a limiting slot formed on the shell, a sliding part movable along the limiting slot, and a compression spring connected between the sliding part and the shell; wherein the sliding part is configured with a first bump, the switch device comprises a micro-switch and the micro-switch comprises a switch part; and the compression spring is configured to be retracted to keep the sliding part maintained in a set position, the first bump of the actuation device and the switch part of a micro-switch matching against each other tightly to keep the switch device turned on.

In an embodiment, the clutch device comprises a plurality of clutch blocks and clutch springs, and the plurality of clutch blocks are connected with each other by the clutch springs; wherein when the rotation speed of the universal motor exceeds the preset rotation speed, the clutch blocks disperse and the clutch springs stretch under centrifugal force, to make the sliding part of the actuation device moved away from the motor shaft, which in turn disengage the first bump of the actuation device from the switch part of the micro-switch to disconnect a power circuit of the universal motor.

In an embodiment, the sliding part of the actuation device comprises a pin shaft configured on an end of the sliding part and a needle bearing configured on the pin shaft coaxially.

In an embodiment, the actuation device further comprises two antifriction plates respectively configured on two end surfaces of the needle bearing.

In an embodiment, the controller is adapted to: compare the rotation speed of the universal motor detected by the rotation speed detector with a preset rotation speed; and keep the control signal transmitted to the drive circuit unchanged, when the rotation speed of the universal motor detected is equal to the preset rotation speed.

In an embodiment, wherein the controller is further adapted to: transmit the control signal to the drive circuit to decrease the rotation speed of the universal motor, when the rotation speed of the universal motor detected is more than the preset rotation speed; and/or transmit the control signal to the drive circuit to increase the rotation speed of the universal motor, when the rotation speed of the universal motor detected is less than the preset rotation speed.

Embodiments of the present invention have the following beneficial effects: the food waste disposer according to embodiments of the invention uses a universal motor which has the characteristics of large torque, strong anti-stalling capacity and low cost, and the universal motor is configured with a control device for controlling the rotation speed of the motor. The rectifier bridge circuit module of the control device converts AC power signal into DC power signal, which increases the power factor of the universal motor when it is at a low speed, reduces useless work and improves useful work.

Besides, the control device keeps the universal motor working at a constant rotation speed by adjusting the PWM value of the power source, which reduces the idle rotation speed of the universal motor and noise, greatly improves the user experience. The inductive element of the control device can make the control device more reliable, more stable and more cost-effective. Furthermore, the diverse needs of users may be fulfilled by setting different constant rotation speeds according to different workplaces, different regions and different users without modifying the motor, which makes the motor may have a variety of different working effects. The food waste disposer may further include a stall protection device, which can disconnect the universal motor power circuit even if the control device is damaged, providing double protection and higher safety during use.

DETAILED DESCRIPTION

Figure 1:
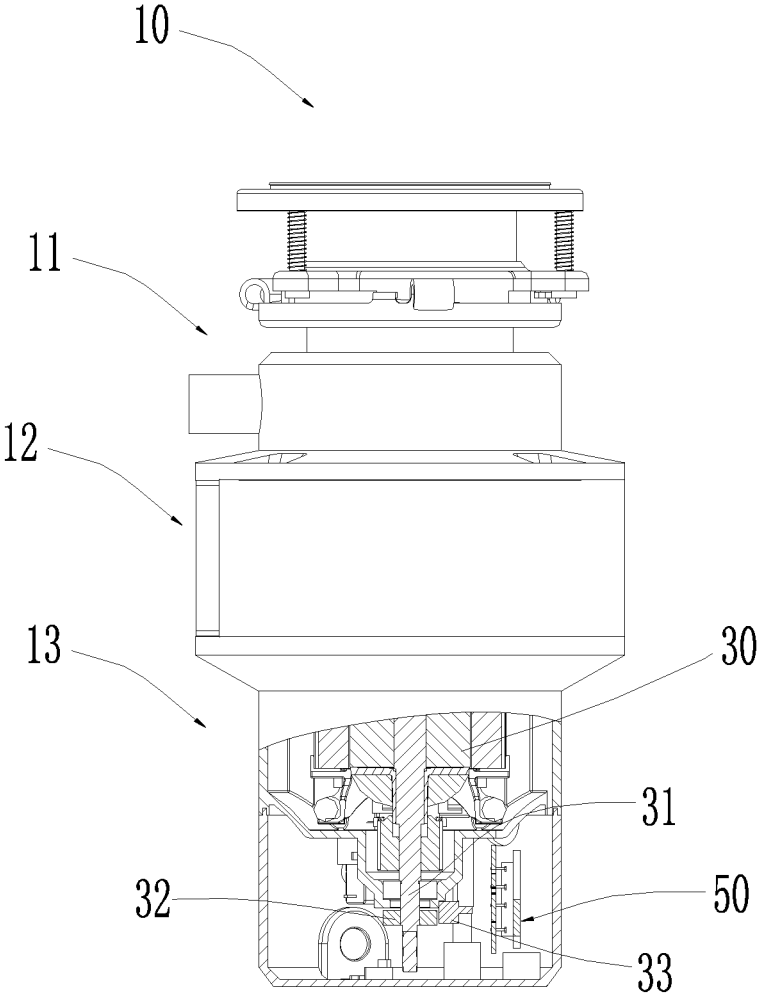
FIG. 1 is a partial cross-sectional view illustrating a structure of a motor section in an embodiment of the present invention.

The invention will be described in more detail below with reference to the detailed description of embodiments shown in the drawings. However, these embodiments do not limit the present invention, based on the embodiments, any modifications, changes in structure, method or function by those skilled in the art, are within the protection scope of the present invention.

Figure 2:
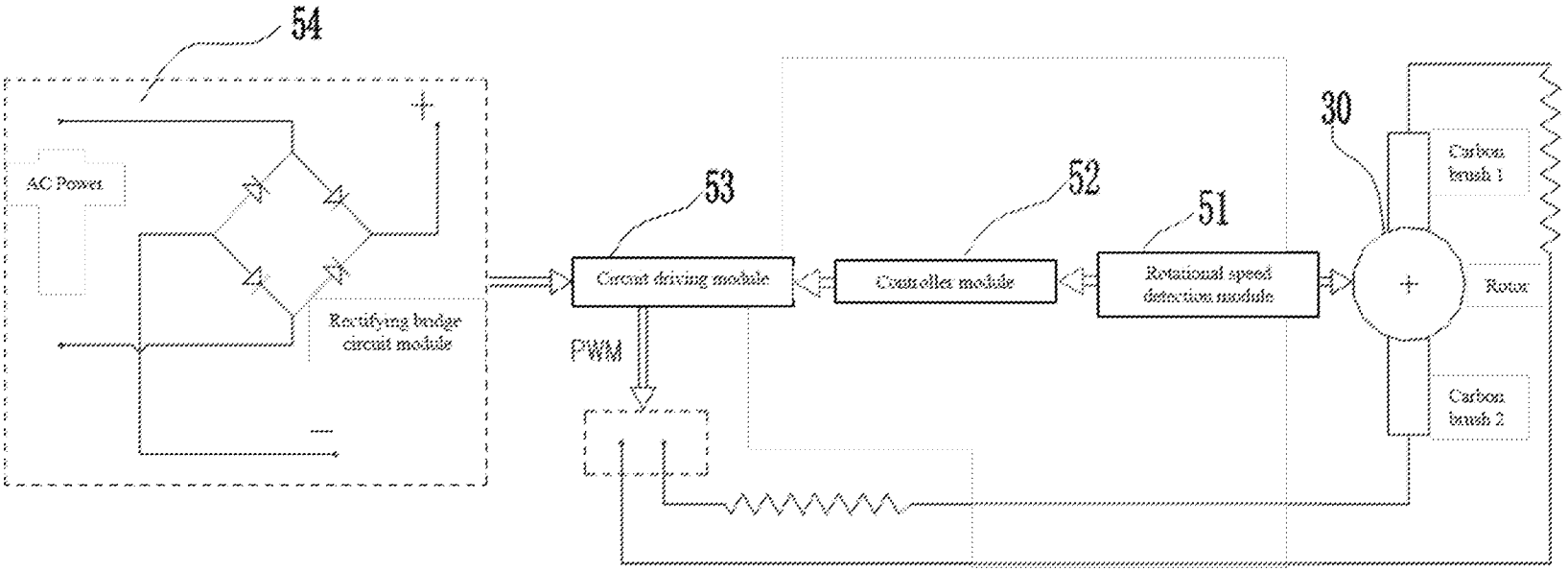
FIG. 2 is a principle diagram of a circuit of a control device in an embodiment of the present invention.

According to FIG. 1 and FIG. 2, an embodiment of the present invention provides a food waste disposer 10, including a food conveying section 11, a grind and discharge section 12 and a motor section 13 used for driving the grind and discharge section 12 to execute a grinding process. The motor section 13 includes a universal motor 30. The universal motor 30 has the advantages of large torque, lock protection function and low cost. The grind and discharge section 12 includes a grinding part and a discharging part, the grinding part includes a grinding mechanism, and the grinding mechanism includes a static grinding ring and a rotary shredder assembly. A plurality of openings are configured on the static grinding ring, the rotary shredder assembly includes a second bump and a grinding disc. The universal motor 30 drives the rotary shredder assembly to rotate, the second bump is used to push the food waste and squeeze the food waste on the plurality of openings of the static grinding ring to smash the food waste. However, except for the grinding manner mentioned above, the grind and discharge section 12 may take other means to grind the food waste. The inner structure and grinding manner of the grind and discharge section 12 cannot be used to limit the protection scope of the present invention.

Figure 3:
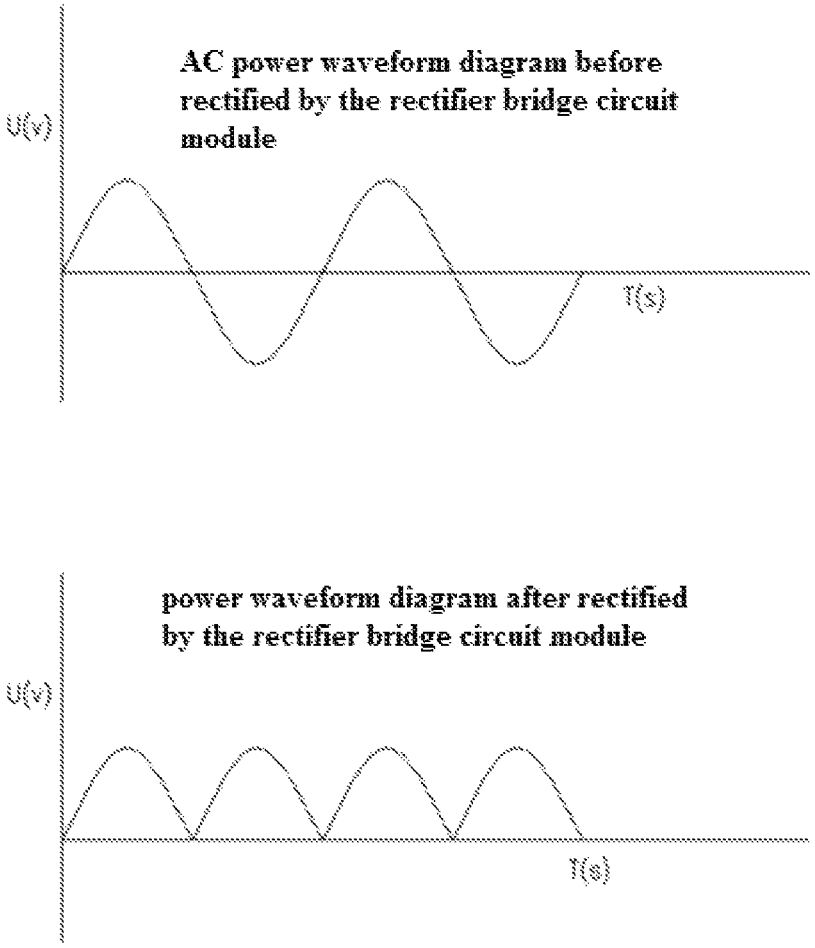
FIG. 3 is a power waveform diagram illustrating two power waveforms respectively before and after rectified by the rectifier bridge circuit module in an embodiment of the present invention.

The universal motor 30 has a control device 50 to control the rotation speed of the universal motor 30. The control device 50 of the universal motor 30 includes a rectifier bridge circuit module 54, and the rectifier bridge circuit module 54 is connected between a drive circuit 53 and the universal motor 30. According to FIG. 3, the rectifier bridge circuit module 54 converts AC power signal into DC power signal, which increases the power factor of the universal motor 30 when it is at a low speed, reduces useless work and improves useful work. The power and the torque of the universal motor 30 will become larger when the universal motor 30 encountered a large load, so that the universal motor 30 can have enough power and torque to drive the cutter disc of the waste disposer to grind food waste, so as to prevent the universal motor 30 from locked rotation.

Figure 4:
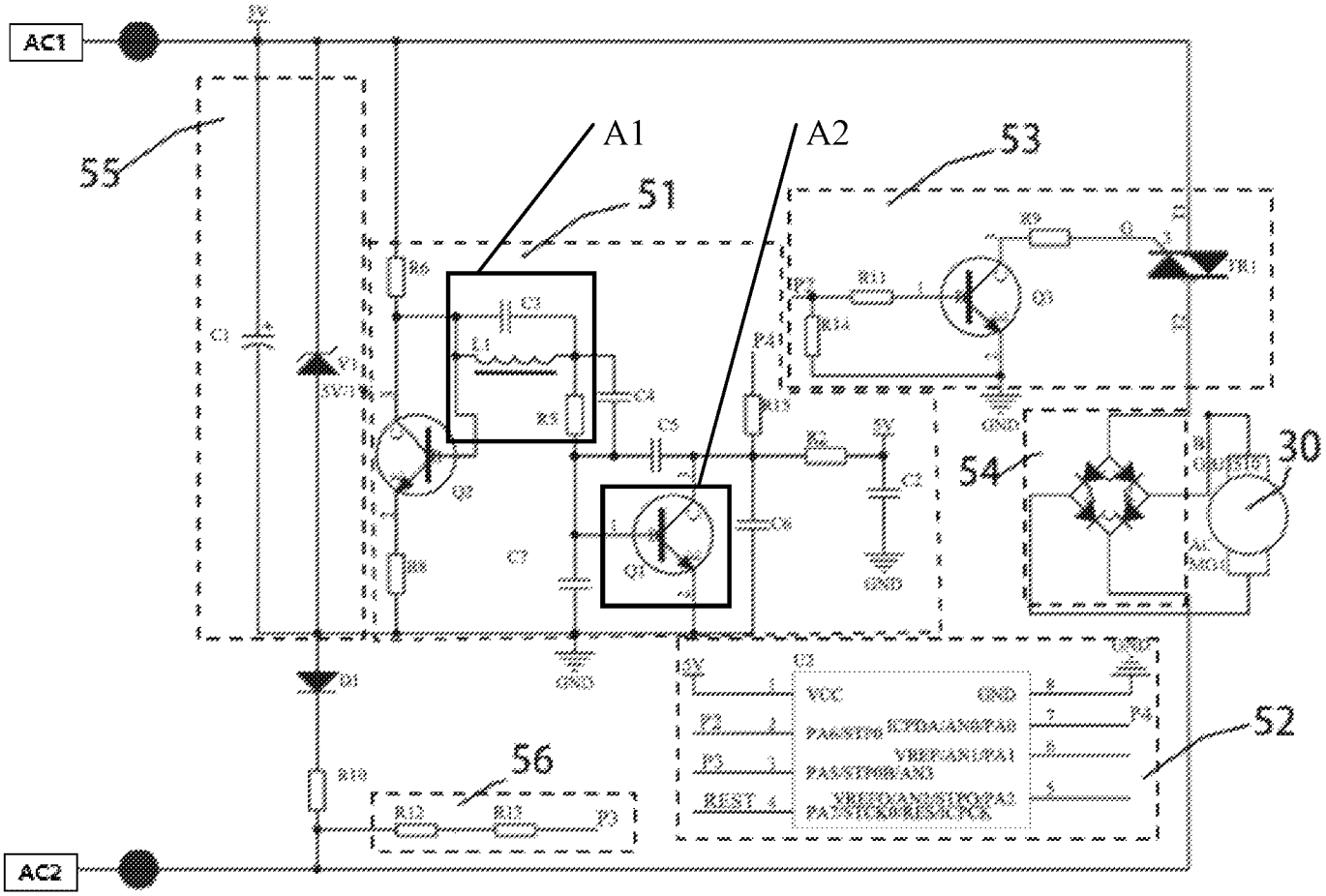
FIG. 4 is a structural diagram of a circuit of a control device in an embodiment of the present invention.

The control device 50 further includes a rotation speed detector 51, and the rotation speed detector 51 includes a magnet ring 32 coaxially configured on a motor shaft 31 of the universal motor 30 and a inductive element 33 that coordinates with the magnet ring 32 for detecting the rotation speed of the universal motor 30. The inductive element 33 in this embodiment may be an induction element L1 as shown in FIG. 4, and the induction element L1 is configured adjacent to the magnet ring 32. When the universal motor 30 is working, the magnet ring 32 rotates synchronously with the motor shaft 31 of the universal motor 30, the magnetic lines generated by the rotation of the magnet ring 32 cut the inductive coils in the induction element L1 configured adjacent to the magnet ring 32, and the inductive coils respectively generate different induced electrical signals when the magnet ring 32 rotates at different rotation speeds. In this embodiment, by using the induction element L1 to detect the rotation speed of the universal motor 30, the rotation speed detector 51 can be more reliable, more stable and more cost-effective than other inductive devices such as a Hall component.

The control device 50 of the universal motor 30 further includes a controller 52 and a drive circuit 53, either connected with the power supply. After the universal motor 30 is powered on, the controller 52 sends a control signal to the drive circuit 53 according to program setting requirements based on the feedback position signal of the stator and rotor position signal fed back from the universal motor 30, then the controller 52 transmits instructions to the drive circuit 53 according to the pre-defined programs, the drive circuit 53 receives the control signal from the controller 52 to provide corresponding PWM value of the power source to the universal motor 30, and then the universal motor 30 starts to work.

The rotation speed detector 51 is connected with the controller 52 and configured to transmit the detected rotation speed signal of the universal motor 30 to the controller 52. In an embodiment, the controller 52 is connected with the drive circuit 53 and configured to transmit different PWM control signals to the drive circuit 53 after perform judgment based on the detected rotation speed signal of the universal motor 30, the drive circuit 53 is configured to output corresponding power source voltage of different PWM values to the universal motor 30, varied with the different control signals. The control device 50 keeps the universal motor 30 working at a constant rotation speed by adjusting the PWM power of the universal motor 30, which reduces the idle rotation speed of the universal motor and noise.

Specifically, at first, the controller 52 judges whether the real-time rotation speed detected by the induction element L1 is equal to a preset rotation speed, if yes, the PWM duty cycle signal that the controller 52 transmit to the drive circuit 53 remains unchanged, if not, then the controller 52 judges whether the real-time rotation speed is more than the preset rotation speed, if yes, the controller 52 transmits a decreased PWM duty cycle signal to the drive circuit 53 to decrease the rotation speed of the universal motor 30, if not, the controller 52 transmits an increased PWM duty cycle signal to the drive circuit 53 to increase the rotation speed of the universal motor 30. It can be seen that the rotation speed of the universal motor 30 is kept constant through controlling of the PWM duty cycle signal. Since the constant rotation speed is much less than the idle rotation speed of the universal motor 30, the idle noise of the food waste disposer 10 may be effectively reduced, and since the universal motor 30 has the characteristics of large torque, lock protection function and low cost, the user experience can be greatly improved.

Those skilled in the art can understand that, although the PWM duty cycle signal is transmitted by the controller 52 to control the rotation speed of the universal motor 30 in the above description, the controller 52 may also transmitting other kinds of control signals to control the rotation speed in other embodiments of the present invention. The specific content and form of the control signal transmitted by the controller 52 cannot be used to limit the protection scope of the present invention.

According to FIG. 4, the rotation speed detector 51 includes a sensing circuit A1 and an amplifier circuit connected with the output of the sensing circuit A1. The sensing circuit A1 at least includes the magnet ring 32, the inductive element 33 for detecting the rotation speed of the universal motor 30, and a filter capacitor C3 configured parallel to the inductive element 33. The inductive element 33 may be an induction element L1 as shown in FIG. 4. When the universal motor 30 is working, the magnetic lines generated by the rotation of the magnet ring 32 cut the induction element L1, and the induction element L1 generates different electrical signals correspondingly when the universal motor 30 is at different rotation speeds, and the generated electrical signal is converted into a voltage signal and then transmitted to the input of the amplifier circuit through a fifth resistance R5.

The amplifier circuit A2 at least includes a first transistor Q1, the inductive voltage signal of the two ends of the fifth resistance R5 of the sensing circuit is inputted to the base electrode of the first transistor Q1, and the collecting electrode C of the first transistor Q1 is connected with the fourth input P4 of the controller 52 through the fifth resistance R15. The amplification process of the electrical signal generated by the sensing circuit is performed by the first transistor Q1, and the voltage signal obtained after the amplification is inputted to the fourth input P4 of the controller 52 after being current limited by the fifteenth resistor R15.

The drive circuit 53 at least includes a third transistor Q3 and a thyristor TR1, and a second output P2 of the controller 52 is connected with the base B of the third transistor Q3 through a resistance R11, so that the control signal used for controlling PWM output power can be inputted to the drive circuit 53. The collecting electrode C of the third transistor Q3 is connected with the gate G of the thyristor TR1 through a ninth resistance R9, and the gate G controls the ON-time of the thyristor TR1 so as to control the magnitudes of the PWM output power.

The control device 50 of the universal motor 30 further includes a voltage-stabilizing and filtering module 55 connected with the power supply, which is used to keep the circuit voltage of the control device 50 steady in 5V. The voltage-stabilizing and filtering module 55 includes a first voltage-stabilizing and filtering capacitor C1 and a voltage regulator V1 configured in parallel to each other. An end of the stabilivolt V1 is connected with a first diode D1, and the first diode D1 is used to keep the circuit unidirectional conductive so as to protect the stabilivolt V1.

The control device 50 of the universal motor 30 further includes a zero-cross detector 56, the zero-cross detector 56 includes a twelfth resistance R12 in series with a thirteenth resistance R13, and an end of the thirteenth resistance R13 is connected with a third input P3 of the controller 52 to input the detected zero-cross signal to the controller 52. The zero-cross detector 56 controls the ON-time of the thyristor TR1 based on the detected zero-cross signal, so as to control the output voltage of the universal motor to keep the rotation speed constant. The diverse needs of users may be fulfilled by setting different constant rotation speeds according to different workplaces, different regions and different users without modifying the motor, which makes the motor may have a variety of different working effects.

Figure 5:
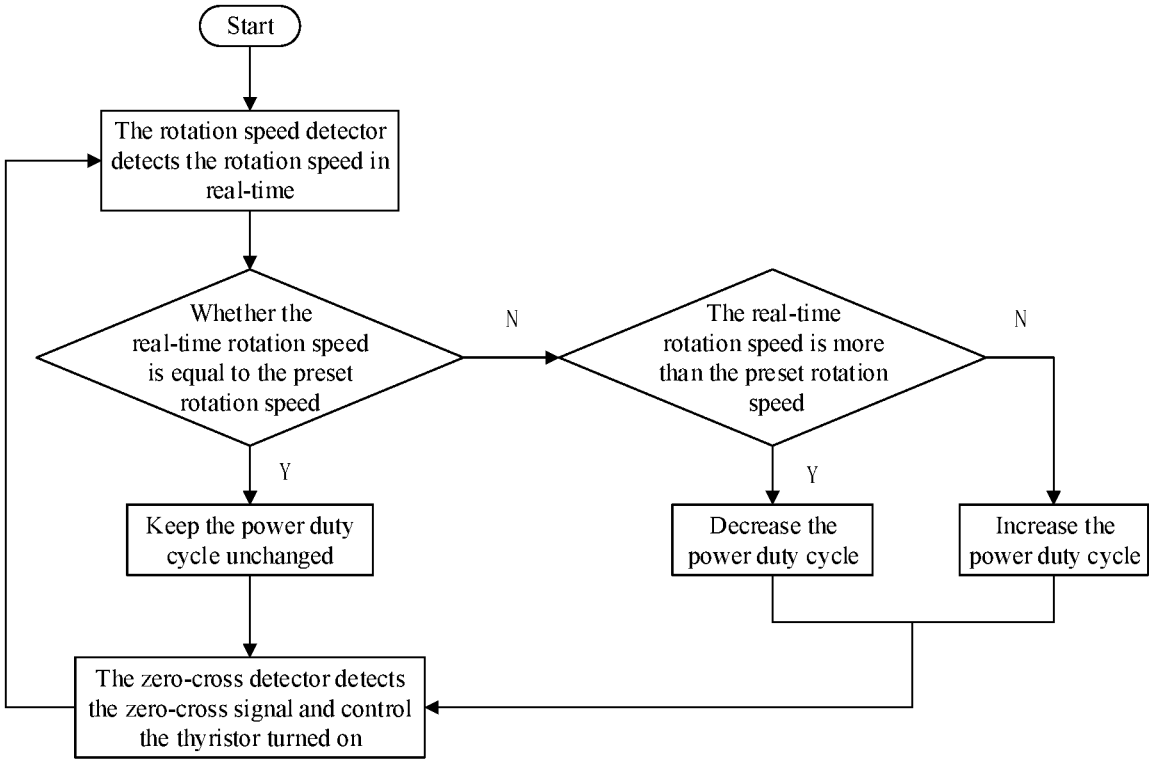
FIG. 5 is a flow chart of a control method of a control device in an embodiment of the present invention.
Figure 6:
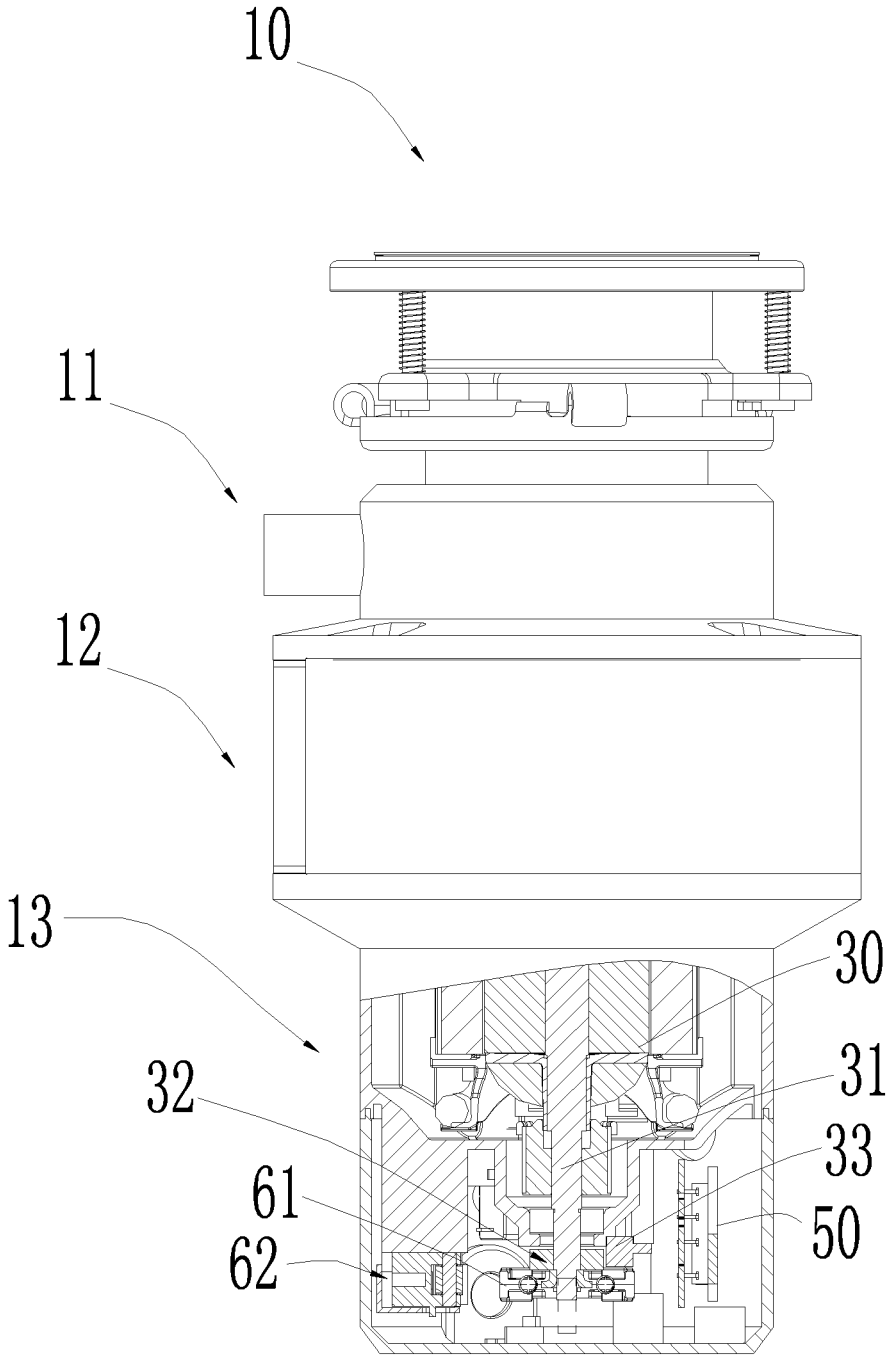
FIG. 6 is a partial cross-sectional view illustrating a structure of a motor section in an embodiment of the present invention.
Figure 7:
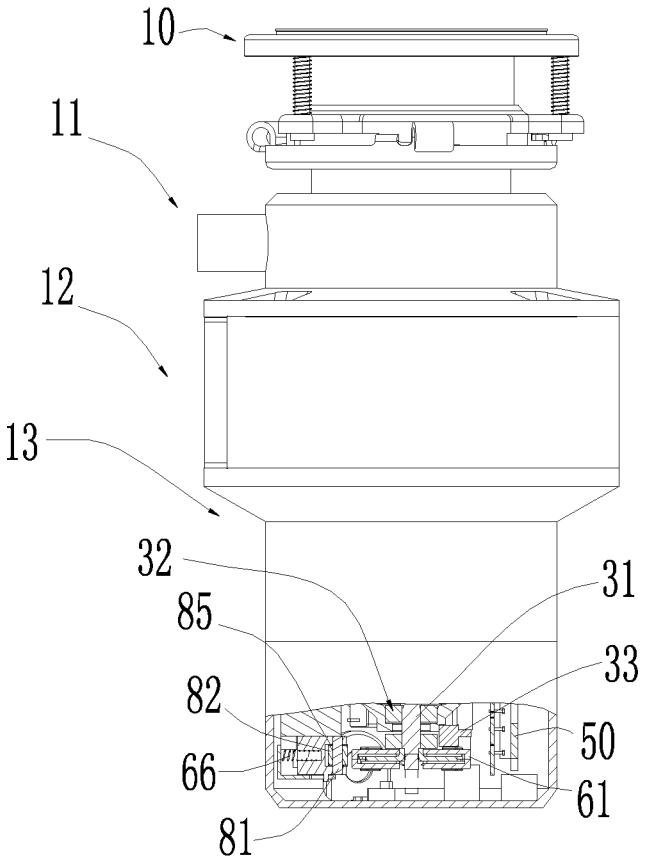
FIG. 7 is a partial cross-sectional view illustrating a structure of a motor section at another angle in an embodiment of the present invention.
Figure 8:
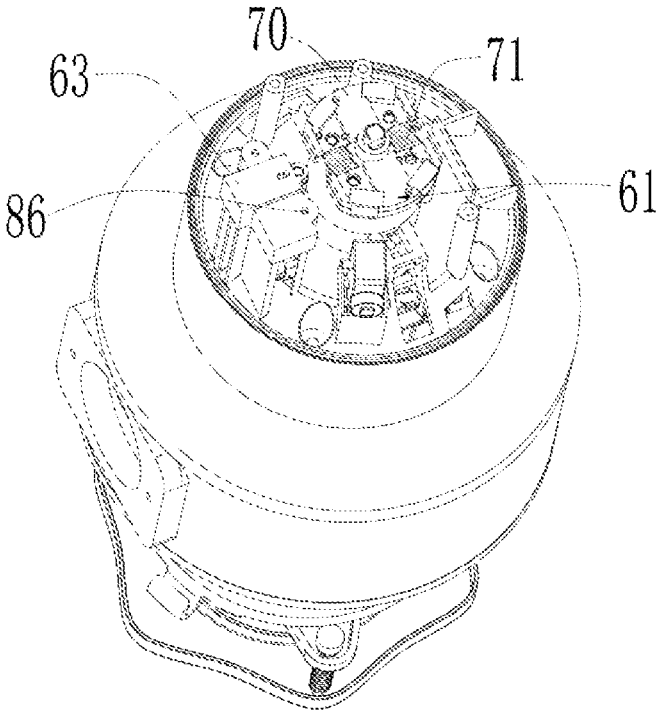
FIG. 8 is a structural diagram of a motor section after a shell is removed in an embodiment of the present invention.
Figure 9:
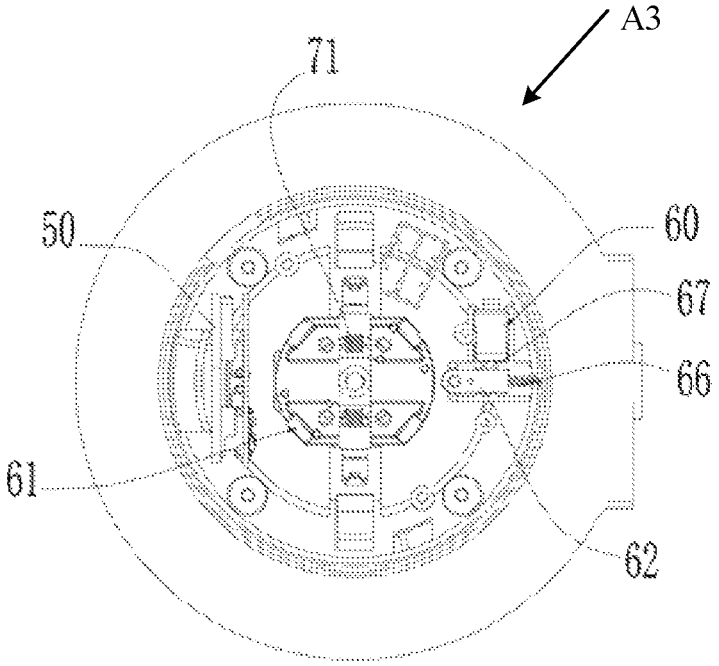
FIG. 9 is a structural diagram of a stall protection device in a normal working state in an embodiment of the present invention.
Figure 10:
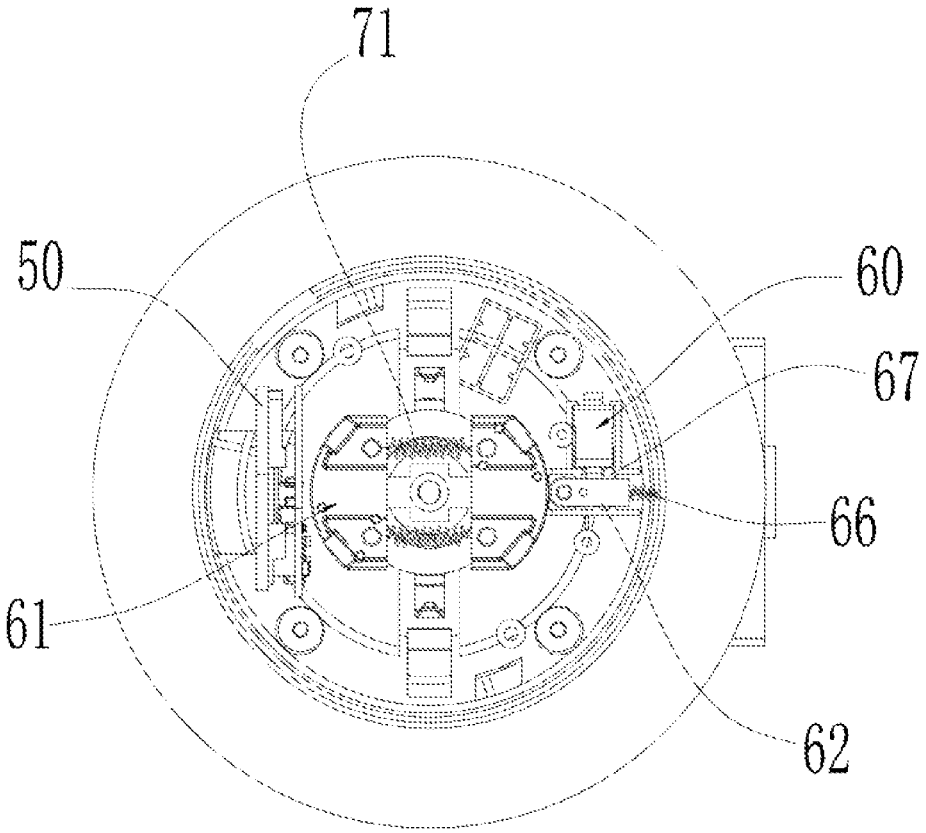
FIG. 10 is a structural diagram of a stall protection device in a stall state in an embodiment of the present invention.

According to FIG. 5, an embodiment of the present invention further provides a control method of a food waste disposer, wherein the food waste disposer includes a food conveying section, a grind and discharge section and a motor section, the motor section includes a universal motor, and the universal motor includes a rotation speed detector, a controller and a drive circuit. The control method of the food waste disposer includes the following steps:

real-time detecting, by the rotation speed detector, the rotation speed of the universal motor, and transmitting the real-time rotation speed signal to the controller;

comparing and judging, by the controller, the real-time rotation speed with a preset rotation speed, and transmitting a PWM duty cycle signal to the drive circuit based on the result of judgment;

providing, by the drive circuit, power output to the universal motor based on the PWM duty cycle signal;

executing the real-time detecting step again.

Specifically, in the comparing and judging process, at first, the controller judges whether the real-time rotation speed is equal to the preset rotation speed, if yes, the PWM duty cycle signal that the controller transmit to the drive circuit remains unchanged, if not, then the controller judges whether the real-time rotation speed is more than the preset rotation speed, if yes, the controller transmits a decreased PWM duty cycle signal to the drive circuit to decrease the rotation speed of the universal motor 30, if not, the controller transmits an increased PWM duty cycle signal to the drive circuit to increase the rotation speed of the universal motor 30, so as to make the universal motor 30 always keep the preset rotation speed. Since the preset rotation speed is much less than the idle rotation speed of the universal motor, the idle noise of the waste disposer may be effectively reduced and the user experience is greatly enhanced.

Those skilled in the art can understand that, although the PWM duty cycle signal is transmitted by the controller to control the rotation speed of the universal motor in the above description, the controller may also transmitting other kinds of control signals to control the rotation speed in other embodiments of the present invention. The specific content and form of the control signal transmitted by the controller cannot be used to limit the protection scope of the present invention.

In an embodiment, the universal motor may further include a zero-cross detector, and the drive circuit may include a thyristor. The step of the zero-cross detector detecting the zero-cross signal and controlling the ON-time of the thyristor based on the zero-cross signal detected may be further included between the comparing and judging step and the providing step. In detail, the zero-cross detector inputs the zero-cross signal to the controller, and the controller controls the ON-time of the thyristor based on the zero-cross signal to adjust the magnitudes of the power output of the universal motor.

According to FIGS. 6-10, another embodiment of the present invention provides a food waste disposer 10, including a food conveying section 11, a grind and discharge section 12 and a motor section 13, wherein the motor section 13 includes a universal motor 30. The difference between this embodiment and the previous embodiment lies in that: in addition to including a control device 50 for adjusting the universal motor 30 to keep a constant rotation speed, the universal motor 30 further includes a stall protection device for disconnecting working power when the universal motor 30 is in stall state. The stall state means that the rotation speed of the universal motor 30 is out of control.

The stall protection device A3 includes a clutch device 61 configured on a motor shaft 31 of the universal motor 30, an actuation device 62 and a switch device 60 connected in series with the circuit of a control device 50 of the universal motor 30. When the control device 50 fails, the rotation speed of the universal motor 30 will no longer be controlled, then the rotation speed of the universal motor 30 will increase uncontrollably. In this situation, when the rotation speed of the universal motor 30 is more than the preset rotation speed, the clutch device 61 collides the actuation device 62 due to the centrifugal force to make the actuation device 62 disconnect with the switch device 60. Even after the control device 50 is damaged, the stall protection device A3 can still disconnect the working power, which provides double protection. In an embodiment, a remind module may be further included in the food waste disposer 10 to remind the user to replace the damaged control device 50 by emitting a sound or light signal for example, which makes the use of the food waste disposer 10 safer, smarter and more convenient.

Figure 11:
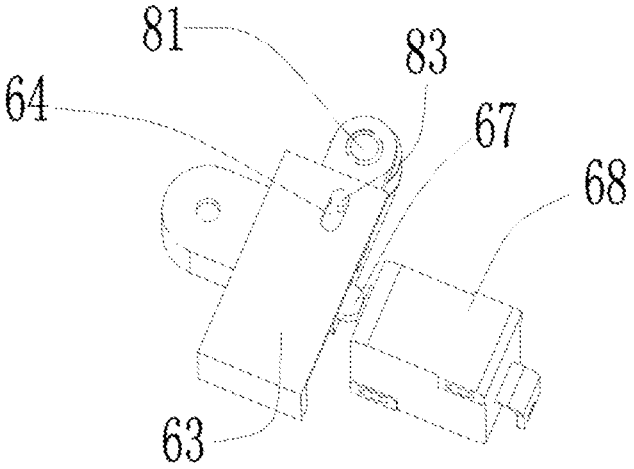
FIG. 11 is a mating structural diagram between an actuation device and a switch device in a normal working state in an embodiment of the present invention.

Specifically, a limiting slot 64 is formed on a shell 63 of the actuation device 62, the actuation device 62 includes a sliding part 65 movable along the limiting slot 64 and a compression spring 66 connected between the sliding part 65 and the shell 63, and the sliding part 65 is configured with a first bump 67. According to FIG. 9 and FIG. 11, the food waste disposer 10 has at least two states, a normal working state and a stall state, when the food waste disposer 10 is in the normal working state, the compression spring 66 is retracted to keep the sliding part 65 maintained in a set position.

In this embodiment, the switch device 60 may include a micro-switch 68, and the micro-switch 68 has a switch part 69. The first bump 67 of the actuation device 62 and the switch part 69 of the micro-switch 68 match against each other tightly to keep the micro-switch 68 turned on when the compression spring 66 is retracted. In other embodiments, the switch device may be an electrically connectable metal sheet or other travel switch, or may be an inductive switch such as a piezoelectric inductive switch, an electromagnetic induction switch, etc.

Figure 12:
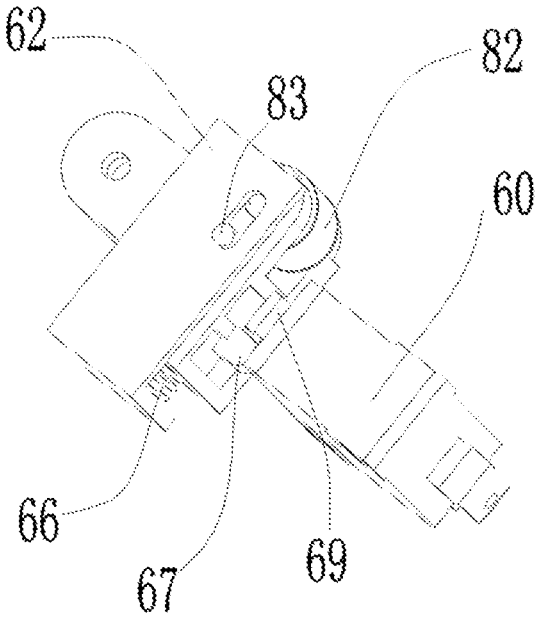
FIG. 12 is a mating structural diagram between an actuation device and a switch device in a stall state in an embodiment of the present invention.

The clutch device 61 includes a plurality of clutch blocks 70, the plurality of clutch blocks 70 are connected with each other by clutch springs 71. In this embodiment, the clutch device 61 includes two clutch blocks 70, and the two clutch blocks 70 and the clutch spring 71 therebetween are configured symmetrically with respect to the motor shaft 31. According to FIG. 10 and FIG. 12, when the food waste disposer 10 is in the stall state, the clutch blocks 70 disperse and the clutch springs 71 stretch under the centrifugal force, to make the sliding part 65 of the actuation device 62 moved away from the motor shaft 31, which in turn disengage the bump 67 of the actuation device 62 from the switch part 69 of the micro-switch 68, so that the power circuit of the universal motor 30 is disconnected by the micro-switch 68.

The sliding part 65 of the actuation device 62 includes a main body of the sliding part 80, a pin shaft 81 configured on an end of the sliding part 80 and a needle bearing 82 configured on the pin shaft 81 coaxially. Since the needle bearing 82 is rotatable about the pin shaft 81, when the clutch block 70 which rotating at a high rotation speed in the stall state collides the needle bearing 82, the needle bearing 82 may reduce the friction between the needle bearing 82 and the clutch block 70 to protect the actuation device 62 and make it working normally.

Figure 13:
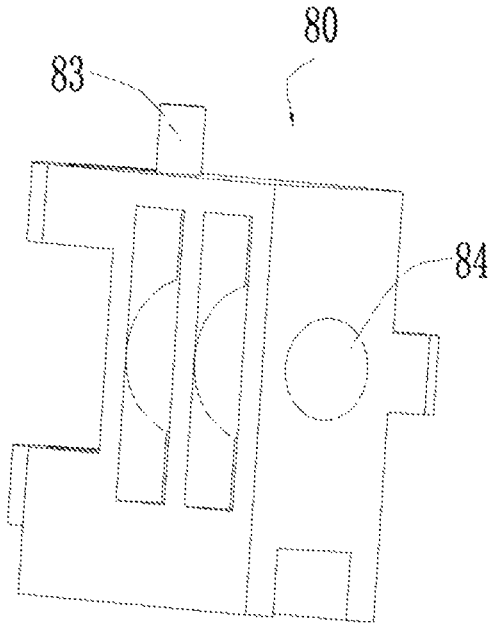
FIG. 13 is a structural diagram of a main body of the sliding part of an actuation device in an embodiment of the present invention.
Figure 14:
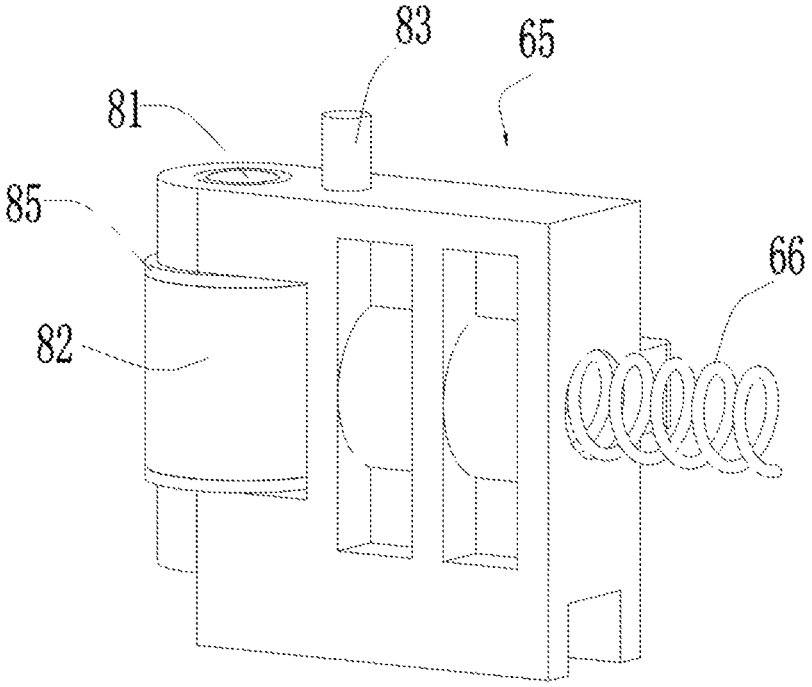
FIG. 14 is a structural diagram of a sliding part of an actuation device in an embodiment of the present invention.

According to FIG. 13 and FIG. 14, the main body of the sliding part 80 has a protrusion part 83 that coordinates with the limiting slot 64 on the shell 63, the protrusion part 83 is located in the limiting slot 64 for limiting the movement of the sliding part 65. A hole 84 for receiving the compression spring 66 is configured on the other end of the main body of the sliding part 80, which makes an end of the compression spring 66 fixedly configured on the main body of the sliding part 80, and the other end of the compression spring 66 connected to the inner wall of the shell 63 of the actuation device 62. The shell 63 is fixed inside the shell of the food waste disposer 10 through a position hole, in the normal working state, the sliding part 65 is stably maintained at a set position by the restoring force of the compression spring 66.

An antifriction plate 85 is configured on the two end surfaces of the needle bearing 82 of the actuation device 62. In this embodiment, the needle bearing 82 is made of metal material, and the reducing plate 85 is used to reduce the friction force with the main body of the sliding part to prevent the noise from increasing.

It should be understood that although the specification is described according to the embodiments, but not each embodiment includes only one independent technical solution. The description of the specification is merely for the sake of clarity, those skilled in the art should take the specification as a whole and the technical solutions in the embodiments may also be combined as appropriate to form other embodiments that can be understood by those skilled in the art.

The detailed descriptions set forth above are merely for the specific description of possible embodiments of the present invention, and are not intended to limit the protection scope of the present invention, any equivalent implementation manner without departing from the technical spirit of the present invention or any changes should be included in the protection scope of the present invention.

What is claimed is:

1. A food waste disposer, comprising a food conveying section, a grind and discharge section and a motor section used for driving the grind and discharge section to execute a grinding process;

wherein the motor section comprises a universal motor, the universal motor comprises a control device for controlling a rotation speed of the universal motor, and the control device comprises a rectifier bridge circuit module for converting an AC power signal into a DC power signal;

wherein the control device further comprises a controller, a drive circuit, and a rotation speed detector, the rotation speed detector is connected with the controller and configured to transmit a detected rotation speed signal to the controller; the controller is connected with the drive circuit and configured to transmit different control signals to the drive circuit after perform judgment based on the detected rotation speed signal; and the drive circuit is configured to output corresponding power source voltage of different values to the universal motor, varied with the different control signals; and the rotation speed detector comprises a sensing circuit, and the sensing circuit comprises a magnet ring coaxially configured on a motor shaft of the universal motor and an inductive element that coordinates with the magnet ring for detecting the rotation speed of the universal motor.

2. The food waste disposer of claim 1, wherein the sensing circuit further comprises a filter capacitor configured parallel to the inductive element.

3. The food waste disposer of claim 1, wherein the rotation speed detector further comprises an amplifier circuit connected with an output of the sensing circuit.

4. The food waste disposer of claim 3, wherein the amplifier circuit comprises a first transistor, and a collecting electrode of the first transistor is connected through a first resistance to a first input of the controller.

5. The food waste disposer of claim 1, wherein the rectifier bridge circuit module is connected between the drive circuit and the universal motor.

6. The food waste disposer of claim 1, wherein the drive circuit comprises a second transistor and a thyristor, a second output of the controller is connected to a base electrode of the second transistor, a collecting electrode of the second transistor is connected through a second resistance to a gate of the thyristor.

7. The food waste disposer of claim 1, wherein the control device further comprises a voltage-stabilizing and filtering module connected with a power supply.

8. The food waste disposer of claim 1, wherein the control device further comprises a zero-cross detector, the zero-cross detector comprises a third resistance in series with a fourth resistance, and an end of the fourth resistance is connected to a second input of the controller.

9. The food waste disposer of claim 8, wherein the drive circuit comprises a thyristor;

wherein the zero-cross detector is adapted to detect zero crossings and control the ON-time of the thyristor based on the detected zero crossings.

10. The food waste disposer of claim 1, wherein the universal motor further comprises a stall protection device for disconnecting working power when the rotation speed of the universal motor exceeds a preset rotation speed.

11. The food waste disposer of claim 10, wherein the stall protection device comprises a clutch device configured on a motor shaft of the universal motor, an actuation device, and a switch device connected in series with a universal motor circuit;

wherein the clutch device is used for making the actuation device act and disconnect the switch device when the rotation speed of the universal motor exceeds the preset rotation speed.

12. The food waste disposer of the claim 11, wherein the actuation device comprises: a shell, a limiting slot formed on the shell, a sliding part movable along the limiting slot, and a compression spring connected between the sliding part and the shell;

wherein the sliding part is configured with a first bump, the switch device comprises a micro-switch and the micro-switch comprises a switch part; and the compression spring is configured to be retracted to keep the sliding part maintained in a set position, the first bump of the actuation device and the switch part of a micro-switch matching against each other tightly to keep the switch device turned on.

13. The food waste disposer of claim 12, wherein the clutch device comprises a plurality of clutch blocks and clutch springs, and the plurality of clutch blocks are connected with each other by the clutch springs;

wherein when the rotation speed of the universal motor exceeds the preset rotation speed, the clutch blocks disperse and the clutch springs stretch under centrifugal force, to make the sliding part of the actuation device moved away from the motor shaft, which in turn disengage the first bump of the actuation device from the switch part of the micro-switch to disconnect a power circuit of the universal motor.

14. The food waste disposer of claim 12 wherein the sliding part of the actuation device comprises a pin shaft configured on an end of the sliding part and a needle bearing configured on the pin shaft coaxially.

15. The food waste disposer of claim 14, wherein the actuation device further comprises two antifriction plates respectively configured on two end surfaces of the needle bearing.

16. The food waste disposer of claim 1, wherein the controller is adapted to:

compare the rotation speed of the universal motor detected by the rotation speed detector with a preset rotation speed; and keep the control signal transmitted to the drive circuit unchanged, when the rotation speed of the universal motor detected is equal to the preset rotation speed.

17. The food waste disposer of claim 16, wherein the controller is further adapted to:

transmit the control signal to the drive circuit to decrease the rotation speed of the universal motor, when the rotation speed of the universal motor detected is more than the preset rotation speed; and/or transmit the control signal to the drive circuit to increase the rotation speed of the universal motor, when the rotation speed of the universal motor detected is less than the preset rotation speed.

* * * * *